United States Patent [19]

Deutschle

[11] Patent Number: 5,004,174

[45] Date of Patent: Apr. 2, 1991

[54] APPARATUS FOR MANIPULATING ROLLS OF CONVOLUTED PAPER WEBS AND THE LIKE

[75] Inventor: Robert Deutschle, Bokholt-Hanredder, Fed. Rep. of Germany

[73] Assignee: E. C. H. Will GmbH, Hamburg, Fed. Rep. of Germany

[21] Appl. No.: 385,811

[22] Filed: Jul. 26, 1989

[30] Foreign Application Priority Data

Jul. 28, 1988 [DE] Fed. Rep. of Germany ..... 3825673

[51] Int. Cl.[5] ..... B65H 19/12

[52] U.S. Cl. ..... 242/58.6; 242/79

[58] Field of Search ..... 242/58.6, 58.2, 58.3, 242/58.4, 67.3 K, 75.1, 58.1, 58.5, 79

[56] References Cited

U.S. PATENT DOCUMENTS

| | | | |
|---|---|---|---|
| 3,690,583 | 9/1972 | Herman | 242/79 X |
| 3,889,831 | 6/1975 | Davis | 242/58.6 X |
| 4,138,072 | 2/1979 | Aoyama et al. | 242/35.5 |
| 4,271,959 | 6/1981 | Eibe | 242/79 X |
| 4,646,986 | 3/1987 | Heitmann | 242/58.1 |
| 4,729,522 | 3/1988 | Tafel et al. | 242/58.3 |
| 4,735,372 | 4/1988 | Seki | 242/58.1 |

FOREIGN PATENT DOCUMENTS

| | | | |
|---|---|---|---|
| 2209328 | 5/1989 | United Kingdom | 242/58.1 |

*Primary Examiner*—Daniel P. Stodola
*Assistant Examiner*—Paul Bowen
*Attorney, Agent, or Firm*—Peter K. Kontler

[57] ABSTRACT

Expired paper rolls are removed from one unwinding station in a paper processing plant by engaging them with a gripper and transferring them onto a conveyor which can be operated to move expired rolls axially. Each expired roll is rotated about its own axis before the conveyor is set in motion so that the projecting remnant of web is convoluted around the expired roll before the latter begins to move axially. The one unwinding station is adjacent a second unwinding station which receives a fresh roll from a conveyance while the preceding roll is caused to pay out its web at the one station. The supporting arms for the roll at the one station are pivotable between the two stations so that a partly expired fresh roll can be shifted from the second station to the one station prior to conversion of such roll into an expired roll.

19 Claims, 8 Drawing Sheets

APPARATUS FOR MANIPULATING ROLLS OF CONVOLUTED PAPER WEBS AND THE LIKE

BACKGROUND OF THE INVENTION

The invention relates to an apparatus for manipulating rolls of convoluted webs, especially paper rolls of the type used in many paper processing plants for the making of pads, for assembling stacks of sheets and the like. More particularly, the invention relates to the manipulation of so-called expired rolls of paper or the like, namely rolls which must be removed from an unwinding station to provide room for fresh rolls.

Webs of paper which are processed in many paper processing plants are supplied in the form of huge rolls wherein a core is surrounded by a large number of convolutions. A huge roll is suspended at an unwinding station and is rotated to pay out the web. When the roll has expired, i.e., when its diameter has been reduced to a predetermined minimum value, such expired roll must be severed from the length of paid out (already unwound) web and the trailing end of the paid out length of the web must be spliced to the leader of a fresh web so as to ensure that the processing machine will receive a continuous web for conversion into sheets, panels or the like or that the intervals of idleness will be as short as possible.

Removal of expired rolls from unwinding stations in or next to paper processing and other web processing machines presents many problems, especially when the rolls are bulky and heavy. As a rule, much of the work which is involved in removing an expired roll from the unwinding station and in replacing it with a fresh roll is still performed by hand. Additional problems arise in connection with the manipulation of expired rolls wherein remnants of the webs project from the cores upon severing of expired rolls from the lengths of paid out web material. Such remnants can interfere with proper manipulation of expired rolls.

OBJECTS OF THE INVENTION

An object of the invention is to provide a novel and improved apparatus for manipulating fresh, partly expired and expired rolls of convoluted paper or the like in paper processing and like plants.

Another object of the invention is to provide an apparatus which can replace expired rolls with fresh rolls in a time-saving manner and in a small area.

A further object of the invention is to provide an apparatus which renders it possible to rapidly replace an expired roll with a fresh roll irrespective of the length and/or diameter of the expired and/or fresh roll.

An additional object of the invention is to provide a novel and improved apparatus for manipulating expired rolls wherein remnants of webs project from the cores when the expired rolls are ready to be replaced with fresh or partly expired rolls.

Still another object of the invention is to provide an apparatus for expediting the exchange of rolls in paper processing and other web processing plants.

A further object of the invention is to provide an apparatus which can be installed in or combined with existing paper processing and other web processing machines to expedite the replacement of expired rolls with fresh rolls of convoluted paper webs or the like.

Another object of the invention is to provide the apparatus with novel and improved means for moving expired rolls.

A further object of the invention is to provide the apparatus with a novel and improved conveyor for expired rolls.

An additional object of the invention is to provide the apparatus with novel and improved means for manipulating expired rolls wherein remnants of webs project from the cores.

Another object of the invention is to provide the apparatus with novel and improved means for properly positioning and orienting fresh rolls prior to expiration of rolls which are in the process of paying out webs of paper or the like.

A feature of the invention resides in the provision of an apparatus for removing expired rolls of convoluted webs from a predetermined unwinding station (particularly for removing expired paper rolls from the unwinding station of a paper processing machine) where a remnant of the web on the expired roll is severed or otherwise separated from the already unwound or paid out length of the webs. The apparatus comprises conveyor means defining a predetermined path for axial movement of expiring rolls, means for rotatably supporting discrete rolls at the predetermined unwinding station, and means for transferring discrete expired rolls from the predetermined unwinding station into the predetermined path. The transferring means includes means for moving expired rolls substantially at right angles to the axes of expired rolls (i.e., preferably in such a way that the orientation of expired rolls remains at least substantially unchanged).

The moving means preferably includes a device for form-lockingly engaging expired rolls during transfer into the predetermined path. Such device can comprise a gripper, and the transferring means can further comprise means for pivoting the gripper between a first position in which the gripper is operative to engage an expired roll at the predetermined unwinding station and a second position for deposition of engaged expired roll on the conveyor means. The gripper can include a plurality of jaws or claws at least one of which is movable relative to at least one other jaw, and the transferring means can further comprise means for moving the at least one jaw relative to the at least one other jaw.

The supporting means can include means for shifting rolls between the predetermined unwinding station and a second unwinding station. Such apparatus can further comprise means for delivering unexpired (particularly fresh) rolls to the second station. The supporting means can be mounted for pivotal movement to shift partly expired rolls from the second unwinding station to the predetermined unwinding station.

The supporting means is preferably designed to confine the rolls at the predetermined unwinding station to rotation about a predetermined axis, and the conveyor means preferably comprises a plurality of rolling elements (e.g., rolling elements each of which comprises two substantially mirror symmetrical conical portions) which form at least one file extending in substantial parallelism with the predetermined axis.

As a rule or in many instances, the remnant tends to or actually project from the expired roll subsequent to severing of such remnant from the already unwound or paid out major length of the web. Therefore, the apparatus preferably further comprises means for convoluting the projecting remnants around the respective expired rolls. Such convoluting means can comprise means for rotating expired rolls about their respective axes. The rotating means preferably comprises a plurality of rollers, preferably substantially cylindrical rollers.

The convoluting means can be located adjacent the predetermined path. In fact, such convoluting means can be integrated into the conveyor means. The axes of rollers which form part of the convoluting means are or can be substantially normal to the axes of rolling elements which form part of the conveyor means. The apparatus can further comprise means for displacing the at least one file of rolling elements relative to the rollers of the convoluting means or vice versa. Such displacing means can comprise elevator means which is designed to move the rollers or the rolling elements between a plurality of different levels. The arrangement can be such that the elevator means is designed to move the rollers to a level at least slightly above the at least one file of rolling elements so that an expired roll which has been transferred into the predetermined path is deposited on and can be rotated by the rollers, and to lower the rollers so that the expired roll which was resting on the rollers can come to rest on the at least one file of rolling elements.

The elevator means can comprise a plurality of levers and means for pivoting the levers to thereby move the rollers or the rolling elements between two or more different levels. The pivoting means can comprise fluid-operated motor means (e.g., a hydraulic or pneumatic cylinder and piston unit). The apparatus can further comprise first drive means for rotating the rolling elements and second drive means for rotating the rollers independently of the rolling elements.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
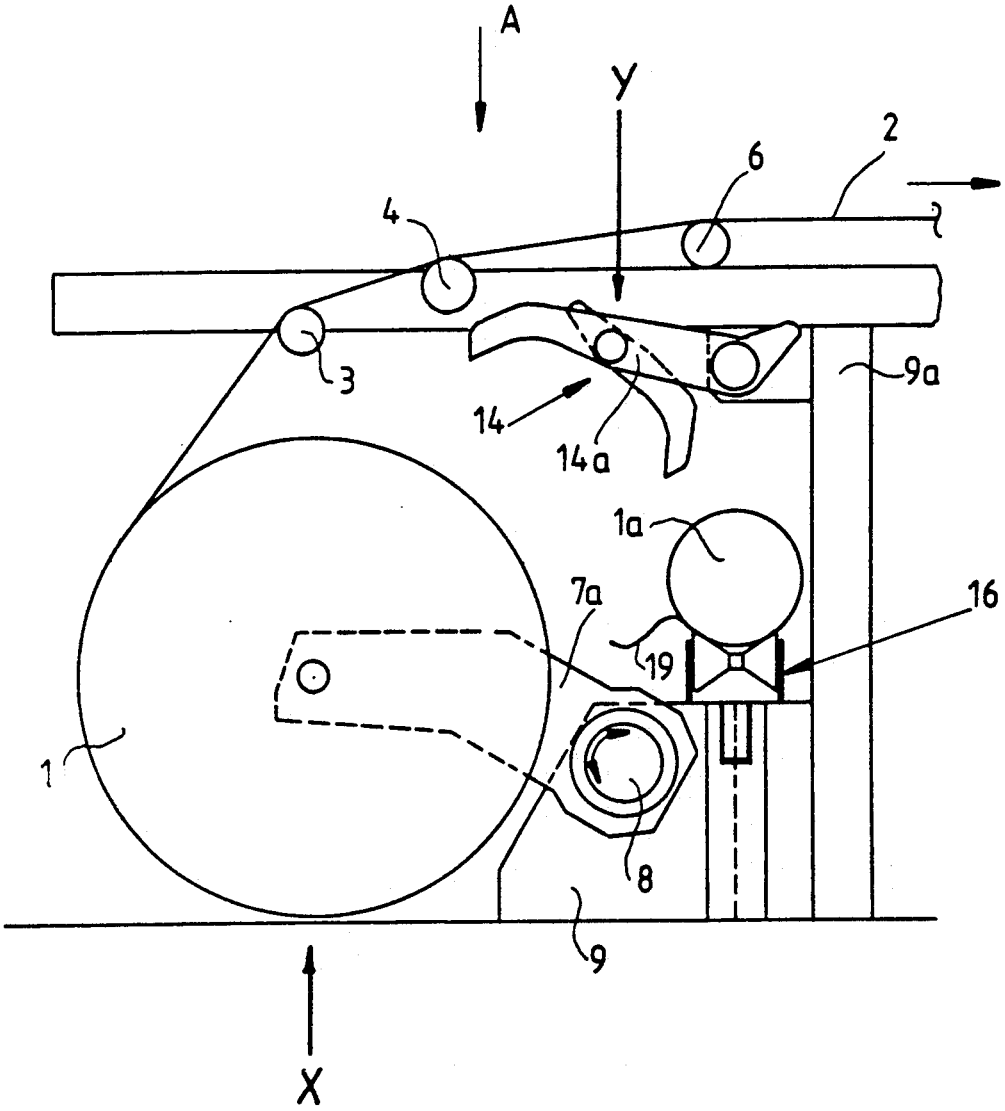
FIG. 1 is a fragmentary schematic end elevational view of an apparatus which embodies one form of the invention, an expiring roll being located at the second unwinding station and a spent or expired roll being ready for convolution of the projecting remnant of web onto the core.
Figure 2:
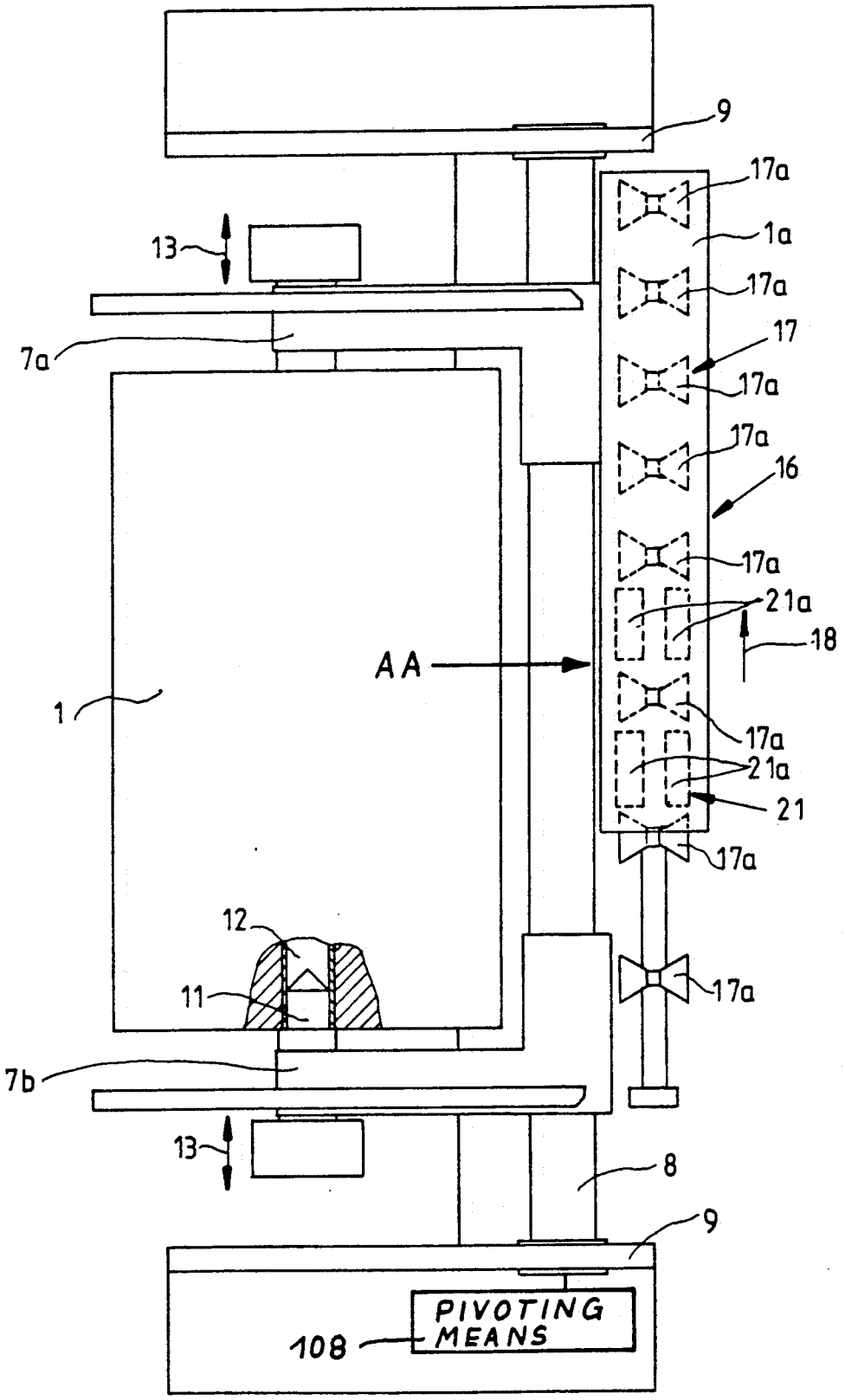
FIG. 2 is a plan view of the apparatus substantially as seen in the direction of arrow A in FIG. 1.

FIGS. 1 and 2 show a portion of an apparatus which can be used in or with a paper web processing or other web processing machine and serves to manipulate fresh rolls 1*b* (FIGS. 9 to 11), expiring rolls 1 and 1' (FIGS. 1, 2, 8 and 9) and expired or spent rolls 1*a* (FIGS. 1, 2, 3, 6, 7 and 10). The expiring roll 1 of FIGS. 1 and 2 pays out its web 2 which is trained over guide rollers 3, 4, 6 and advances into a processing machine (not shown), e.g., into a machine which subdivides the webs 2 into sheets and assembles sheets into stacks (e.g., reams) which are ready for wrapping.

The expiring roll 1 is located at a (second) unwinding station X and the end portions of its at least partially hollow core 12 (FIG. 2) are releasably held by two supporting arms 7*a*, 7*b* at opposite axial ends of the convoluted web 2. The supporting arms 7*a*, 7*b* are pivotable about the axis of a horizontal shaft 8 which is mounted in the lower part of the frame 9 of the improved apparatus and can be turned back and forth (as indicated in FIG. 1 by a double-headed arrow) so as to enable the arms 7*a*, 7*b* to support the expiring roll 1 in a first position (at the unwinding station X) or in a second position at a predetermined unwinding station Y (note the partly expired roll 1' in FIG. 9). The means (108) for pivoting the supporting arms 7*a*, 7*b* between the positions of FIGS, 1, 2, 8 (at the unwinding station X) and the positions of FIG. 9 (at the unwinding station Y) can comprise one or more levers which are rigid with the shaft 8 and one or more fluid-operated (hydraulic or pneumatic) motors which pivot the lever or levers whenever a partly expired roll is to be shifted from the station X to the station Y. It is also possible to design the pivoting means 108 in such a way that it transmits motion directly to at least one of the supporting arms 7*a*, 7*b*.

The supporting arms 7*a*, 7*b* carry mandrels 11 (FIG. 2) which are reciprocable in directions indicated by double-headed arrows 13 in order to enter into or to be withdrawn from the respective ends of the core 12 of a roll between the supporting arms. When the arms 7*a*, 7*b* support a roll at the station X, such roll is rotatable about a first axis which is parallel to the axis of a roll at the station Y. In other words, the orientation of a roll which is being shifted from the station X to the station Y remains unchanged, i.e., the shifting step is carried out by moving the roll at right angles to its axis. The mandrels 11 can be reciprocated by hand or by suitable motors, not shown.

A fresh roll (1*b*) is delivered to the unwinding station X and is held at such station in a state of readiness while the diameter of an expiring roll (1 or 1') at the unwinding station Y is being reduced to a predetermined minimum value. This is detected by suitable sensor means of any known design (such sensor means are used in all kinds of paper processing and other plants, for example, in cigarette making machines to ensure that the web on an expiring roll of cigarette paper can be spliced in time to the leader of the web on a fresh roll of cigarette paper so as to avoid interruptions in the making of cigarettes), and the expired roll la is then transferred from the station Y into an elongated horizontal path which is defined by a conveyor 16 serving as a means for evacuating expired rolls la from the apparatus.

The means (14) for transferring expired rolls 1*a* from the supporting arms 7*a*, 7*b* at the unwinding station Y onto the conveyor 16 comprises a gripper 14*a* which is designed to form-lockingly engage an expired roll 1*a* and to deposit it on a file 17 of rolling elements 17*a* forming part of the conveyor 16. The gripper 14*a* is designed to move expired rolls 1*a* at right angles to their respective axes, i.e., in such a way that the orientation of an expired roll 1*a* does not change during transfer from the station Y into the elongated path which is defined by the conveyor 16. The latter is designed to convey expired rolls 1*a* in the direction of their longitudinal axes (arrow 18), i.e., in parallelism with the axis of the roll at the unwinding station X or Y.

The gripper 14*a* is movably mounted on or adjacent the columns 9*a* of the frame 9. This gripper can deposit expired rolls 1*a* (one roll at a time) onto the aforementioned rolling elements 17*a* of the file 17 which forms part of the conveyor 16. Each rolling element 17*a* comprises two mirror symmetrical conical portions, and each such rolling element can be rotated about an axis which is normal to the axis of the expired roll 1*a* on the conveyor 16. This ensures that, when the rolling elements 17*a* are driven, they can advance an expired roll 1*a* in the direction of arrow 18, namely in the direction of the longitudinal axis of expired roll 1*a*. The expired rolls 1*a* can be discarded or their cores 12 can be reused for convolution of webs of paper or the like therearound.

Figure 10:
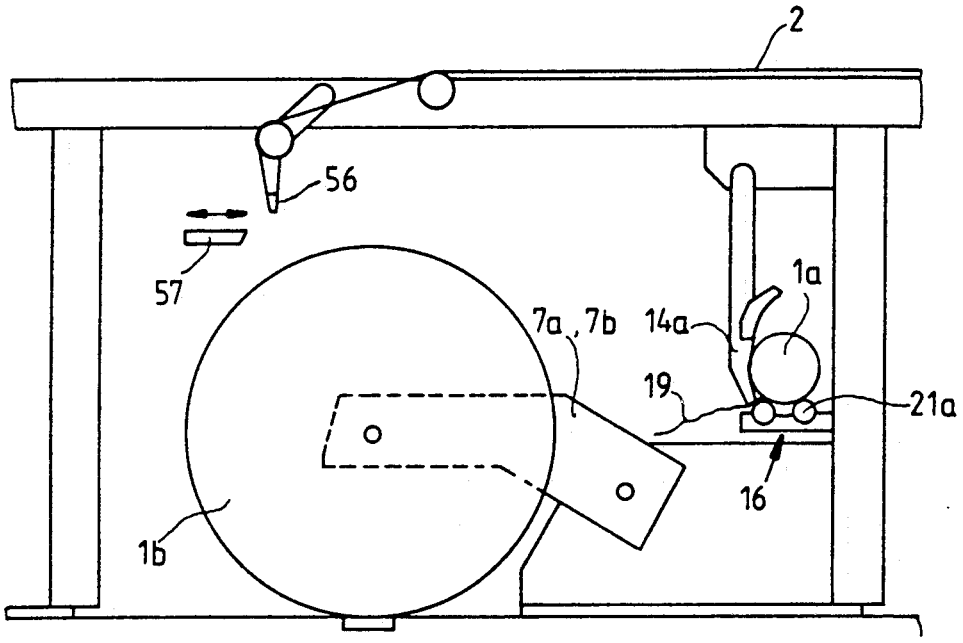
FIG. 10 shows the structure of FIGS. 8 and 9 but with an expired roll on the rollers of the convoluting means.

FIG. 1 shows that the expired roll 1*a* on the conveyor 16 carries a remnant 19 of the web 2 and that such remnant projects from its core. The remnant 19 is formed during severing of the expired roll 1*a* from the web 2 which was paid out by such roll (the means for severing expired rolls 1*a* from the respective webs is shown in FIG. 10, as at 57), and such remnant could interfere with proper conveying of expired roll 1*a* in the direction of arrow 18 and/or during next-following stages of manipulation of the expired roll. Therefore, the improved apparatus further comprises means 21 for convoluting projecting remnants 19 around the cores 12 of the respective expired rolls 1*a* or around those convolutions of web which continue to surround the core 12 when the corresponding roll 1*a* is classifiable as an expired roll. The convoluting means 21 includes two pairs of cylindrical rollers 21*a* which serve to rotate an expired roll 1*a* about its axis subsequent to transfer of the expired roll from the unwinding station Y.

In the illustrated embodiment of the improved apparatus, the convoluting means 21 is integrated into the conveyor 16 and is designed to convolute the remnant 19 around the core 12 or around the outermost convolution of the web on the core of the respective expired roll 1*a* before the latter begins to move axially (arrow 18) in response to rotation of the rolling elements 17*a*. The axes of the rollers 21*a* in the convoluting means 21 are parallel to the axis of the expiring roll 1*a*. FIG. 2 shows a first pair of rollers 21*a* between the second and third rearmost rolling elements 17*a* and a second pair of rollers 21*a* between the third and fourth rearmost rolling elements 17*a*. The number of pairs of such rollers can be increased to three or more, depending on the length of expired rolls 1*a* which are to be rotated prior to advancing in the direction of arrow 18. When the rollers 21*a* are operative to rotate an expired roll 1*a*, they are maintained at a level such that they alone support the expired roll, i.e., the expired roll does not contact the rolling elements 17*a*.

Figure 3:
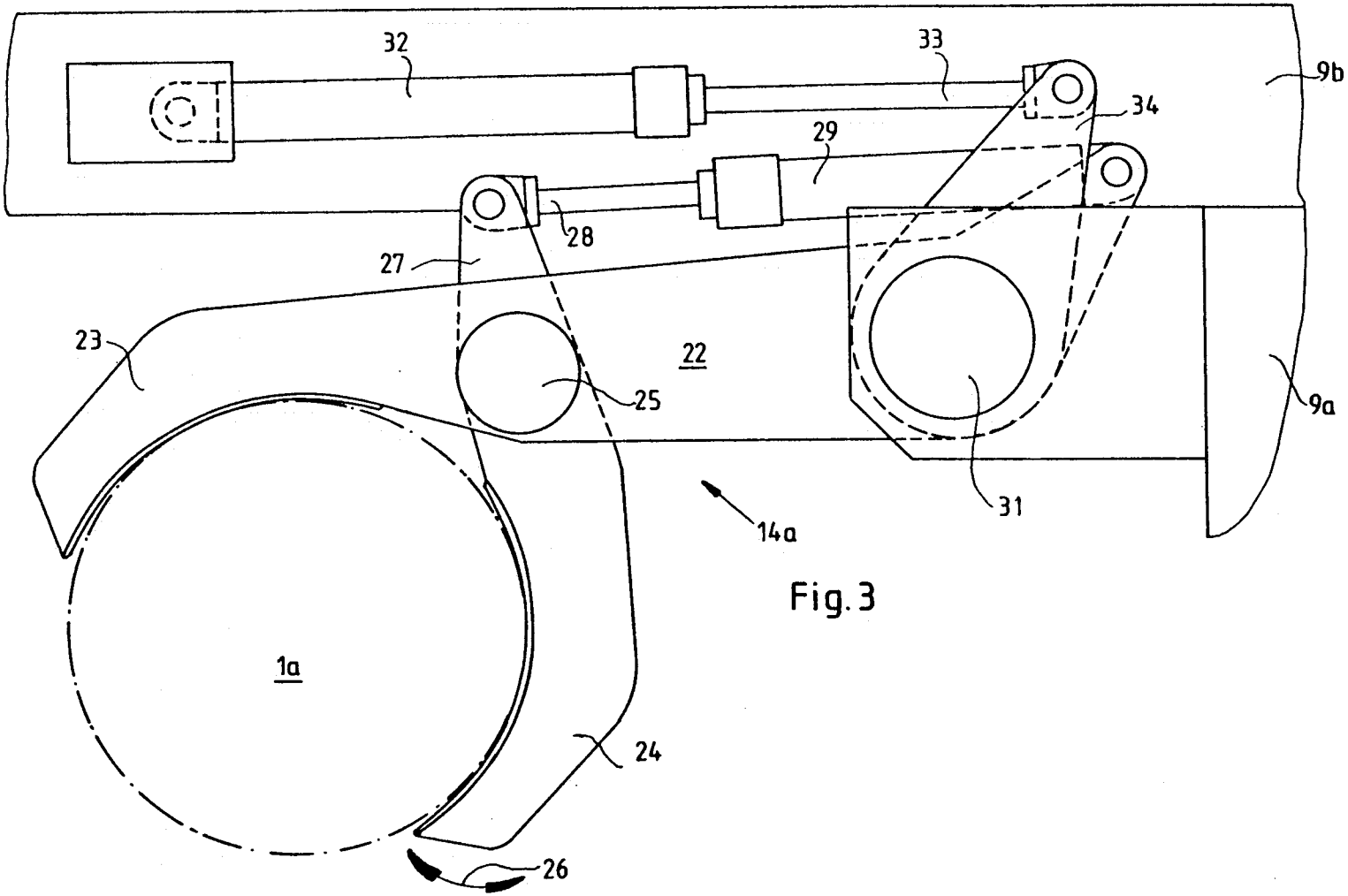
FIG. 3 is an enlarged view of a detail in FIG. 1, showing an expired roll at the predetermined unwinding station.
Figure 4:
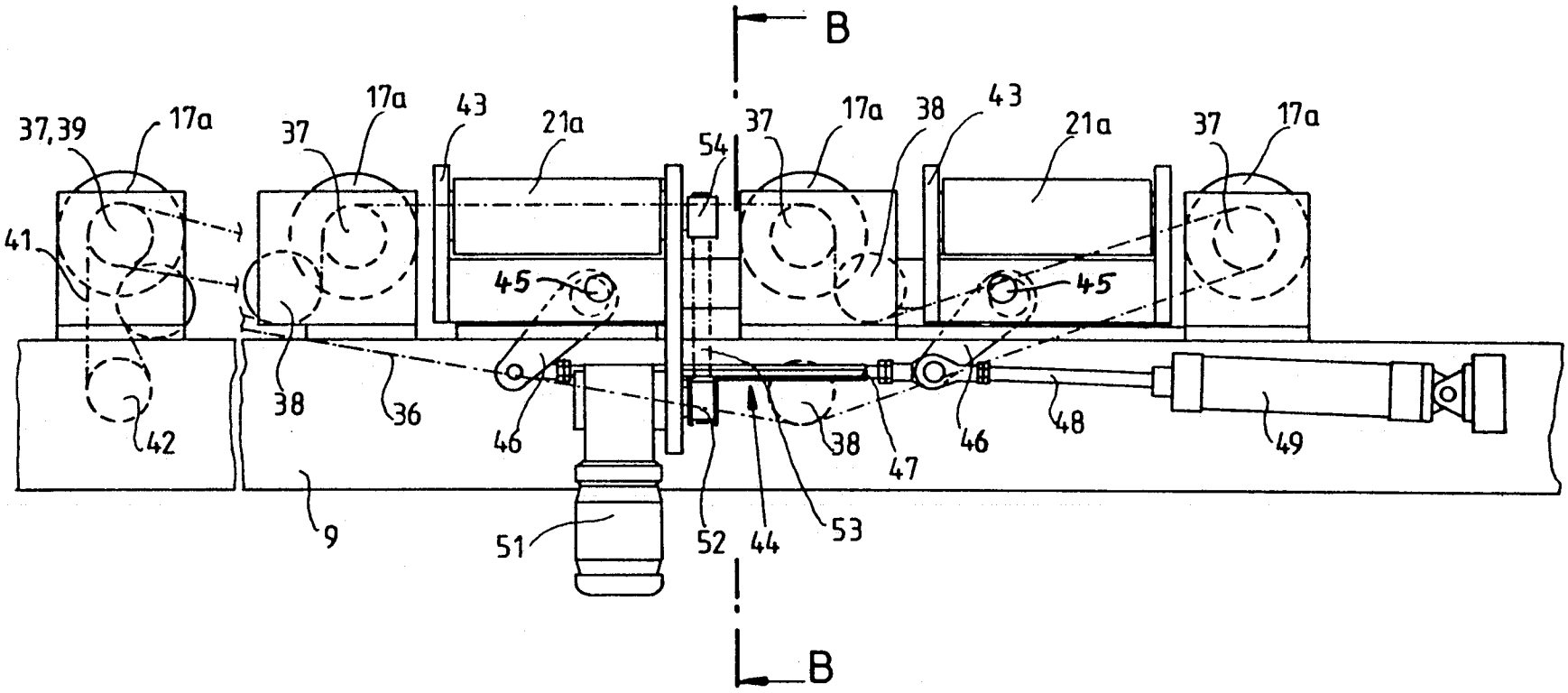
FIG. 4 is an enlarged fragmentary side elevational view of the conveyor for expired rolls substantially as seen in the direction of arrow AA in FIG. 2.
Figure 5:
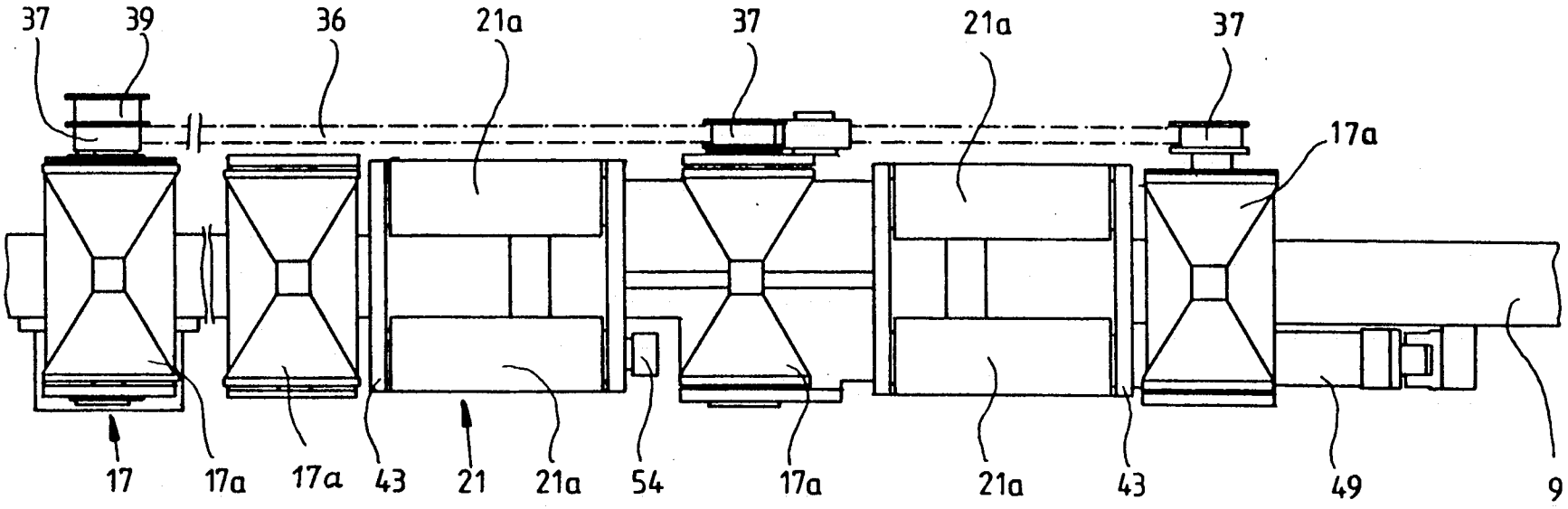
FIG. 5 is a plan view of the structure which is shown in FIG. 4.

The details of a presently preferred gripper 14*a* are shown in FIG. 3. This gripper comprises an elongated arm 22 the free end portion of this constitutes a first jaw or claw 23. The other end portion of the arm 22 is pivotable about the horizontal axis of a shaft 31 which is carried by or adjacent the columns 9*a* of the frame 9 beneath a top frame member 9*b*. The gripper 14*a* further comprises a second jaw or claw 24 which cooperates with the jaw 23 to firmly grip an expired roll 1*a* preparatory to transfer from the unwinding station Y into the elongated path which is defined by the conveyor 16. The jaw 24 is pivotably connected to the arm 22 by a horizontal pivot member 25 and has an extension 27 which coupled to the free end of a reciprocable piston rod 28 forming part of a fluid-operated motor which further includes a hydraulic or pneumatic cylinder 29. The latter is pivotably mounted on the frame 9.

The arm 22 is pivotable with the jaws 23, 24 about the axis of the shaft 31 by a second fluid-operated motor including a piston rod 33 and a hydraulic or pneumatic cylinder 32. The cylinder 32 is articulately connected to the frame member 9*b* and the piston rod 33 is articulately connected to an extension 34 which is rigid with the arm 22 or with the shaft 31, depending upon whether the shaft 31 is rotatably mounted in the frame 9 and is rigid with the arm 22 or whether the arm 22 and the extension 34 can turn about the shaft 31. The just described movability of the arm 22 and both jaws 23, 24 about the axis of the shaft 31 and the movability of the jaw 24 about the axis of the pivot member 25 enable the gripper 14*a* to firmly engage an expired roll 1*a* at the unwinding station Y (i.e., to accept or take over such expired roll from the supporting arms 7*a*, 7*b* when these arms assume the positions of FIG. 9) and to transfer the expired roll 1*a* into the elongated path which is defined by the conveyor 16 so that the expired roll comes to rest on the (then raised) rollers 21*a* of the convoluting means 21. Alternatively, the gripper 14*a* can deposit an expired roll 1*a* on the rolling elements 17*a* of the file 17 of such rolling elements if the operation of the improved apparatus is programmed in such a way that the rollers 21*a* are lifted to raise the expired roll 1*a* above and away from the rolling elements 21*a* after the expired roll has been released by the jaws 23, 24 of the gripper 14*a*.

The motor 32, 33 causes the jaws 23, 24 to jointly pivot about the axis of the shaft 31, and the motor 28, 29 can be operated to pivot the jaw 24 with reference to the jaw 23 in directions which are indicated by a double-headed arrow 26. The jaws 23, 24 are preferably long (as seen in the direction of arrow 18) so that they can reliably grip a relatively long and heavy expired roll 1*a* preparatory to transfer of such expired roll from the unwinding station Y to the conveyor 16. For example, the length of each of the two jaws 23, 24 can equal or approximate the length of an expired roll 1*a*.

The details of the conveyor 16 and convoluting means 21 are shown in FIGS. 4 to 7. The conveyor 16 comprises a drive for its rolling elements 17*a*, and this drive comprises a pulley or sprocket wheel 37 on the shaft of each rolling element 17*a*, an endless flexible element 36 (such as a toothed belt or a chain) which is trained over the pulleys or sprocket wheels 37 and over guide pulleys or sprocket wheels 38, and means for rotating one of the pulleys or sprocket wheels 37. Such rotating means comprises a second pulley or sprocket wheel 39 (FIGS. 4 and 5) on the shaft of the leftmost rolling element 17*a*, an electric motor 42 or another prime mover in or on the frame 9, a pulley or sprocket wheel on the output element of the prime mover 42', and an endless flexible element 41 (toothed belt or chain) which is trained over the pulley or sprocket wheel 39 and over the pulley or sprocket wheel on the output element of the prime mover 42.

A separate drive is provided to rotate one of the rollers 21*a* of the convoluting means 21. This separate drive comprises a gear motor 51 which is mounted on a housing 43 for the rollers 21*a*, a first pulley or sprocket wheel 52 which is driven by the output element of the motor 51, a second pulley or sprocket wheel 54 on the shaft of the one roller 21*a*, and an endless flexible element 53 (such as a toothed belt or a chain) which is trained over the pulleys or sprocket wheels 52, 54.

The elevator means 44 for moving the housing 43 with the rollers 21*a* up and down with reference to the file 17 of rolling elements 17*a* comprises a system of levers 46 which are articulately connected to the frame 9, a link 47 which couples the levers 46 to each other, and a fluid-operated (hydraulic or pneumatic) motor for moving the link 47 in order to pivot the levers 46. The levers 46 have eccentric pins 45 or analogous parts (e.g., cranks) which engage the housing 43 and can raise or lower the housing with the rollers 21*a* in response to longitudinal displacement of the link 47. The fluid-operated motor comprises a hydraulic or pneumatic cylinder 49 which is articulately connected to the frame 9 and a piston rod 48 which is articulately connected to one end of the link 47 or to one of the levers 46.

Figure 7:
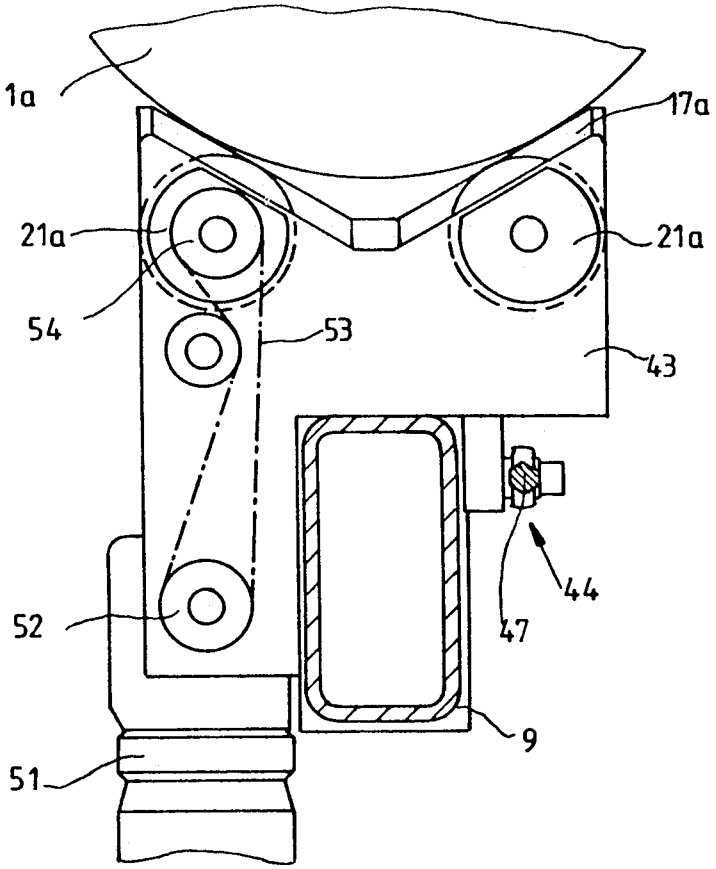
FIG. 7 shows the structure of FIG. 6 but with the convoluting means in inoperative position with the expired roll resting on the rotary elements of the conveyor.
Figure 6:
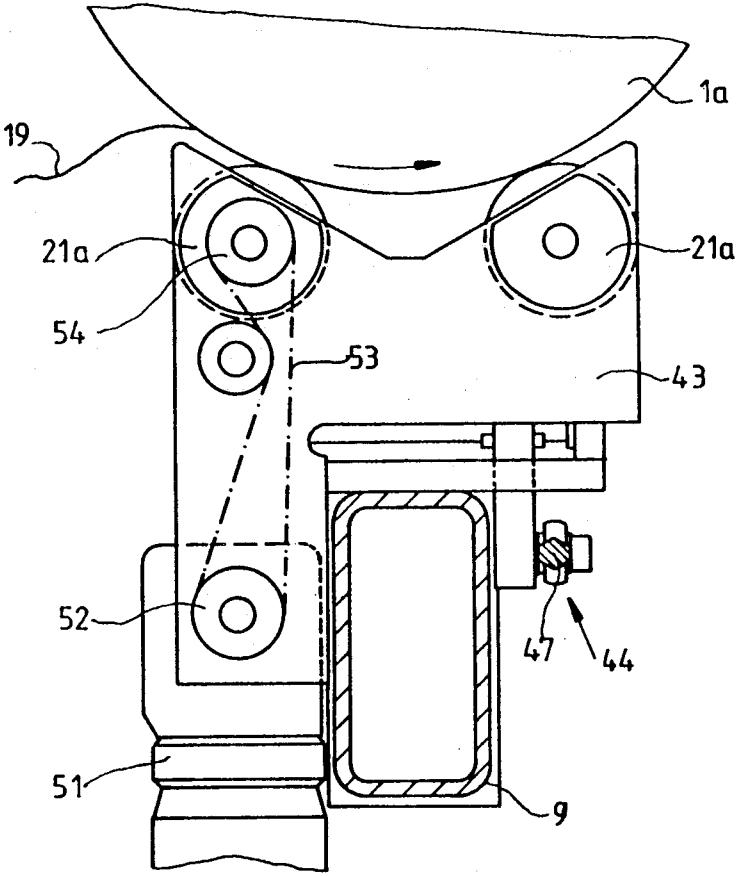
FIG. 6 is an enlarged transverse vertical sectional view substantially as seen in the direction of arrows from the line B—B of FIG. 4, the convoluting means of the apparatus being shown in the operative position in which its rollers support and can rotate an expired roll.

FIG. 6 shows the housing 43 in raised position in which the cylindrical rollers 21*a* of the convoluting means 21 extend to a level above the rolling elements 17*a* or, otherwise stated, to a level such that an expired roll 1*a* rests only on the rollers 21*a* and is not in contact with the rolling elements 17*a*. If the motor 51 is started while the housing 43 is held in the position of FIG. 6, the driven roller 21*a* cooperates with the other three (idler) rollers 21*a* to convolute the remnant 19 about the expired roll 1*a* by rotating the latter in a counterclockwise direction (as seen in FIG. 6). When the convoluting operation is completed, the motor 48, 49 of the elevator 44 is operated to lower the housing 43 so that the expired roll 1*a* comes to rest on the rolling elements 17*a* (as shown in FIG. 7) and is ready to be conveyed in the direction of arrow 18 in response to starting of the motor 42.

Figure 8:
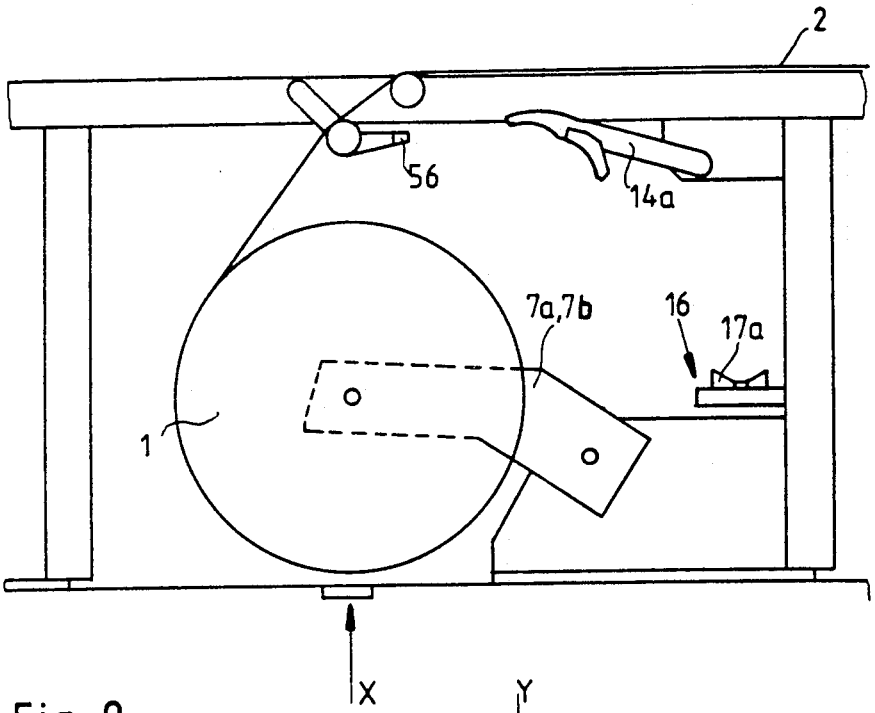
FIG. 8 is an end elevational view of the apparatus with an expiring roll at the second unwinding station.

The mode of operation of the improved apparatus will be described with reference to FIGS. 8 to 11. FIG. 8 shows an expiring roll or a fresh roll 1 at the (second) unwinding station X. The gripper 14*a* is maintained in a position of readiness at the (predetermined) unwinding station Y and the roll 1 is carried by the supporting arms 7*a*, 7*b*. The web 2 which is being unwound from the roll 1 advances toward and into the processing machine, not shown. The diameter of the roll 1 at the unwinding station X decreases gradually as the web 2 advances into the processing machine and, when this diameter is reduced to a predetermined value (this is detected by the aforementioned sensor), the pivoting means 108 receives a signal which causes the supporting arms 7*a*, 7*b* to shift the partly expired roll 1' from the station X to the station Y while the roll 1' continues to pay out the web 2. The roll 1' is then adjacent the gripper 14*a* but the latter does not interfere with the unwinding of the web 2.

At the same time, a fresh roll 1*b* is delivered (e.g., by a dolly or another conveyance) to the (then unoccupied) unwinding station X (FIG. 9) and is maintained therein in a position of readiness for splicing of the leader of its web to the trailing end of the web 2 which is being paid out by the partly expired roll 1' at the unwinding station Y. Thus, a fresh roll 1*b* can be introduced into the improved apparatus while the preceding roll (1') is still in the process of supplying its web 2 to the processing machine.

When the diameter of the partly expired roll 1' is reduced to a predetermined minimum value (this is detected by a suitable sensor at the unwinding station Y), the already unwound or paid out length of the web 2 is severed or otherwise separated from the thus obtained expired roll 1*a* (converted partly expired roll 1') by a reciprocable knife 57 (FIG. 10) in cooperation with a suction-operated strip 56 which attracts the trailing end of the severed length of web 2 to maintain such trailing end in an optimum position for splicing to the leader of the web on the fresh roll 1*b*. The manner of splicing trailing ends of paid out webs to leaders of fresh webs is well known from the arts of paper processing, cigarette making and many other fields and, therefore, need not be described here. All that counts is to ensure that the apparatus is equipped or cooperates with suitable means for severing successive expired rolls 1*a* from the trailing ends of the paid out lengths of webs 2 so that an expired roll 1*a* at the unwinding station Y can be engaged by the jaws 23, 24 of the gripper 14*a* for transfer into the path which is defined by the conveyor 16. The suction-operated strip 56 is pivotably mounted on the frame member 9*b* and is pivoted to its operative position (in which it attracts the trailing end of a web 2) in response to conversion of a partly expired roll 1' into an expired roll 1*a*.

Figure 11:
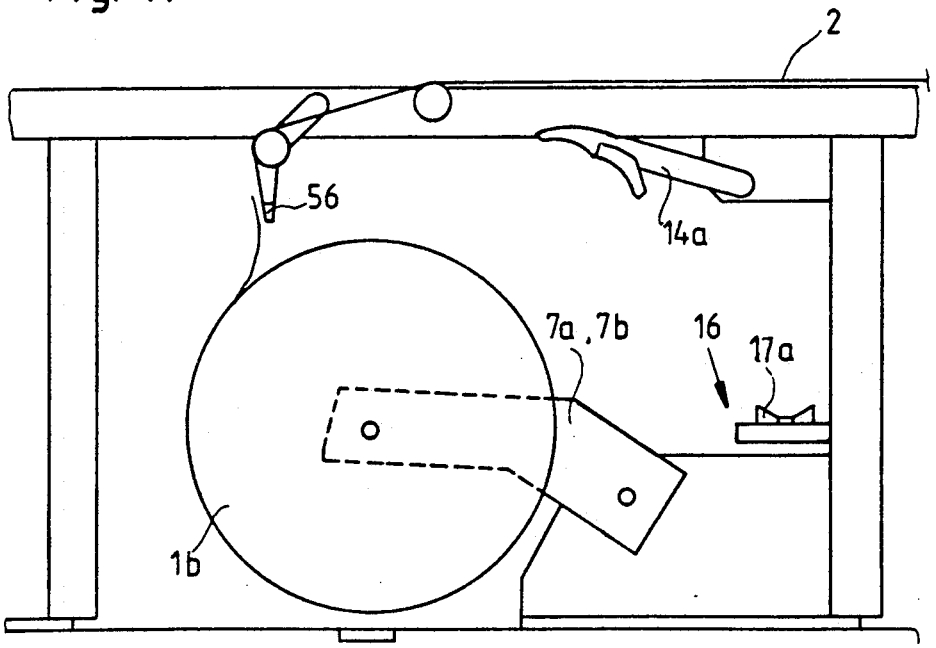
FIG. 11 shows the structure of FIG. 10 with the expired roll removed and with the fresh roll in the process of having the leader of its web spliced to the trailing end of the length of web which was paid out by the preceding roll.

The motor 48, 49 lifts the housing 43 and the rollers 21*a* to the positions of FIG. 6 not later than when the gripper 14*a* completes the transfer of the expired roll 1*a* onto the conveyor 16. This can also be seen in FIG. 10. The motor 51 then rotates one of the rollers 21*a* and the one roller 21*a* cooperates with the other three rollers 21*a* to convolute the remnant 19 of web 2 onto the expired roll 1*a* before the housing 43 is lowered to transfer the expired roll 1*a* onto the rolling elements 17*a*. The next step involves operation of the motor 42 which rotates the rolling elements 17*a* in a direction to move the expired roll 1*a* in the direction of arrow 18. FIG. 11 shows the apparatus upon completed evacuation of the expired roll 1*a* of FIG. 10. The strip-shaped suction-operated device 56 is in the process of positioning the trailing end of the preceding web 2 for splicing to the leader of the web which is convoluted on the unexpired (fresh) roll 1*b*.

Figure 9:
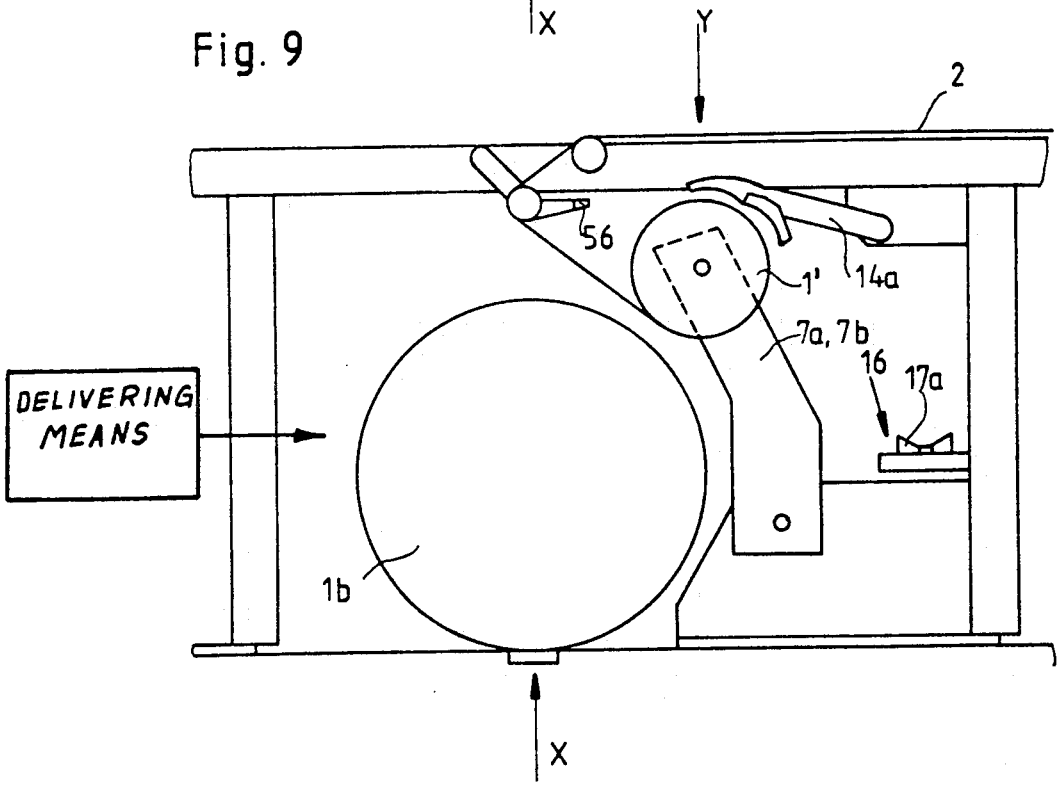
FIG. 9 illustrates the structure of FIG. 8 with an expiring roll at the predetermined unwinding station and a fresh roll at the second unwinding station.

The supporting arms 7*a*, 7*b* are pivoted from the positions of FIG. 9 to the positions of FIG. 10 (to be properly coupled to the core of the fresh roll 1*b*) as soon as the expired roll 1*a* is properly held by the gripper 14*a* for transfer onto the conveyor 16. The gripper 14*a* pivots back to the idle position of FIGS. 8 and 9 as soon as it has deposited the expired roll 1*a* on the rollers 21*a* of the convoluting means 21.

Once the roll 1*b* begins to pay out its web, this roll corresponds to the roll 1 of FIG. 8 and is manipulated in the same way as described above, i.e., it is first converted into a partly expired roll (1') which is shifted from the station X to the station Y, it is then converted into an expired roll (1*a*) which is transferred onto the conveyor 16, the expired roll is rotated about its own axis, and the thus rotated expired roll is then evacuated by moving it in the direction of arrow 18.

It is also within the purview of the invention to design the conveyor 16 or an analogous conveyor in such a way that its rolling elements 17*a* can be raised and lowered with reference to the cylindrical rollers 21*a* of the convoluting means 21. The illustrated conveyor 16 is preferred at this time because the number of rollers 21*a* is smaller than that of the rolling elements 17*a*. Furthermore, the fluid-operated motor 48, 49 constitutes but one form of means for moving the linkage including the parts 46, 47 in order to raise and lower the housing 43 for the rollers 21*a*. In addition, one and the same motor (42 or 51) can be used to rotate the rolling elements 17*a* or the rollers 21*a*. The illustrated rolling elements 17*a* can be replaced with otherwise configurated rolling elements even though rolling elements in the form of twin cones are preferred at this time because they ensure highly accurate guidance of an expired roll 1*a* during conveying of such roll in the direction of arrow 18.

An important advantage of the improved apparatus is that expired rolls 1*a* can be rapidly evacuated from the unwinding station Y and that a fresh roll (1*b*) can be delivered to the station X while the partly expired roll (1') at the station Y continues to pay out its web into the processing machine. This shortens or eliminates the intervals of idleness between unwinding of webs from successive rolls.

Another important advantage of the improved apparatus is that its operation can be automated to any desired extent. Thus, if desired, the operation can be automated to such an extent that no manual work is involved at any stage of delivery of a fresh roll (1*b*) into the apparatus, of shifting of a partly expired roll from the station X to the station Y, of transferring an expired roll from the station Y onto the conveyor 16, of convoluting the remnant 19 onto the respective expired roll, and of evacuating an expired roll from the apparatus. This is of particular importance in certain paper processing and like plants wherein the webs are supplied in the form of huge and very heavy rolls.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for removing expired paper rolls from an unwinding station of a paper processing machine wherein a remnant of the web on an expired roll is severed from the already unwound length of the web and wherein the remnant of the web projects or tends to project from the roll subsequent to severing of the remnant from the already unwound length of the web, comprising conveyor means defining a predetermined path for axial movement of expired rolls; means for rotatably supporting discrete rolls at said unwinding station, said supporting means including means for confining the rolls at said unwinding station to rotation about a predetermined axis and said conveyor means comprising a plurality of rolling elements forming at least one file extending in substantial parallelisms with said predetermined axis; means for convoluting the projecting remnants around the respective expired rolls, said convoluting means being adjacent a portion of said path; and means for transferring discrete expired rolls from said unwinding station into said path, including means for moving expired rolls substantially at right angles to the axes of expired rolls.

2. The apparatus of claim 1, wherein said moving means includes a device for form-lockingly engaging expired rolls during transfer into said path.

3. The apparatus of claim 2, wherein said engaging means includes a gripper.

4. The apparatus of claim 1, wherein said convoluting means comprises means for rotating expired rolls about their respective axes.

5. The apparatus of claim 4, wherein said rotating means comprises a plurality of rollers.

6. The apparatus of claim 1, wherein said convoluting means is integrated into said conveyor means.

7. The apparatus of claim 6, wherein said convoluting means includes a plurality of rollers arranged to rotate expired rolls about their respective axes, the axes of said rolling elements being normal to the axes of said rollers.

8. The apparatus of claim 7, further comprising means for displacing one of said at least one file of rolling elements and said plurality of rollers relative to the other of said at least one file of rolling elements and said plurality of rollers.

9. The apparatus of claim 8, wherein said displacing means includes elevator means for raising said plurality of rollers to a level above said at least one file of rolling elements so that a transferred expired roll comes to rest on the raised rollers, and for lowering the rollers so that the expired roll which was resting on the rollers comes to rest on said at least one file of rolling elements.

10. The apparatus of claim 8, wherein said displacing means includes elevator means for moving the rollers or the rolling elements between a plurality of different levels.

11. The apparatus of claim 10, wherein said elevator means includes a plurality of pivotable levers and means for pivoting said levers.

12. The apparatus of claim 11, wherein said pivoting means comprises fluid-operated motor means.

13. The apparatus of claim 1, further comprising first drive means for rotating said rolling elements and second drive means for rotating said rollers.

14. The apparatus of claim 1, wherein each of said rolling elements comprises two mirror symmetrical conical portions

15. The apparatus of claim 1, wherein said transferring means comprises a gripper and means for pivoting said gripper between a first position in which the gripper is operative to engage an expired roll at said unwinding station and a second position for deposition of engaged expired roll on said conveyor means.

16. The apparatus of claim 15, wherein said gripper includes a plurality of jaws at least one of which is movable relative to at least one other jaw, and further comprising means for moving said at least one jaw relative to said at least one other jaw.

17. The apparatus of claim 1, wherein said supporting means further includes means for shifting rolls between said predetermined unwinding station and a second unwinding station.

18. The apparatus of claim 17, further comprising means for delivering unexpired rolls to said second station, said supporting means being pivotable to move partly expired rolls from said second station to said predetermined station.

19. Apparatus for removing expired paper rolls from an unwinding station of a paper processing machine wherein a remnant of the web on the expired roll is severed from the already unwound length of the web and wherein the remnant of the web projects or tends to project from the roll subsequent to severing of the remnant from the already unwound length of the web, comprising conveyor means defining a predetermined path for axial movement of expired rolls; means for rotatably supporting discrete rolls at said unwinding station; means for transferring discrete expired rolls from said unwinding station into said path, including means for moving expired rolls substantially at right angles to the axes of expired rolls; and means for convoluting the projecting remnants around the respective expired rolls, said convoluting means comprising means for rotating expired rolls about their axes and said rotating means comprising a plurality of substantially cylindrical rollers.

* * * * *